US010768564B2

(12) United States Patent
Katsumata

(10) Patent No.: US 10,768,564 B2
(45) Date of Patent: Sep. 8, 2020

(54) IMAGE FORMING APPARATUS AND STORAGE MEDIUM

(71) Applicant: KONICA MINOLTA, INC., Chiyoda-ku, Tokyo (JP)

(72) Inventor: Keiki Katsumata, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/667,033

(22) Filed: Oct. 29, 2019

(65) Prior Publication Data

US 2020/0142338 A1 May 7, 2020

(30) Foreign Application Priority Data

Nov. 6, 2018 (JP) ..... 2018-208518

(51) Int. Cl.
*G03G 15/00* (2006.01)
*G03G 15/02* (2006.01)
*G03G 21/00* (2006.01)

(52) U.S. Cl.
CPC ..... *G03G 15/5037* (2013.01); *G03G 15/0266* (2013.01); *G03G 21/0035* (2013.01); *G03G 2215/00632* (2013.01)

(58) Field of Classification Search
CPC ..... G03G 15/5037; G03G 15/0266; G03G 21/0035; G03G 2215/00632
See application file for complete search history.

(56) References Cited

U.S. PATENT DOCUMENTS

2012/0189330 A1* 7/2012 Kunimatsu ..... G03G 15/1665 399/44

FOREIGN PATENT DOCUMENTS

JP H11237825 A 8/1999

* cited by examiner

*Primary Examiner* — Clayton E. LaBalle
*Assistant Examiner* — Michael A Harrison
(74) *Attorney, Agent, or Firm* — Buchanan Ingersoll & Rooney PC

(57) ABSTRACT

An image forming apparatus includes an image former and a hardware processor. The image former includes, an image carrier; a developer; a conductive rotating member; and a voltage applier which applies voltage to the rotating member. The hardware processor executes an attached material detection mode which detects material attached to a surface of the rotating member. In such mode, the hardware processor controls the voltage so that the developing bias is a value between a surface potential in a region of the image carrier in contact with a portion in which attached material exists on a surface of the rotating member if a reference voltage is applied by the voltage applier, and a surface potential in a region of the image carrier in contact with a portion in which the attached material does not exist on the surface of the rotating member if the reference voltage is applied.

15 Claims, 9 Drawing Sheets

IMAGE FORMING APPARATUS AND STORAGE MEDIUM

BACKGROUND

Technological Field

The present invention relates to an image forming apparatus and a storage medium.

Description of the Related Art

Conventionally, in the image forming apparatus employing the electro-photographic method, there is a technique to slide a cleaning brush or a cleaning blade against a surface of an image carrier such as a photoconductor on which a toner image is formed to remove attached material such as residual toner attached to the surface of an image carrier.

When the image carrier is cleaned by the cleaning brush, in order to reduce the adhesion strength of the toner attached to the image carrier and to enhance the cleaning performance, there is a technique to apply lubricant to be attached to the image carrier. For example, a lubricant applying brush which rotates while coming into contact with the surface of the image carrier and a solid lubricant are used to apply the lubricant. The lubricant applying brush rotates so that the lubricant shaved from the solid lubricant is applied evenly to the surface of the image carrier.

The lubricant applying brush scrapes the surface of the image carrier to function as the cleaning brush. With this, the amount of the residual toner which reaches the cleaning blade positioned on the downstream side of the photoconductor in the rotating direction is decreased, and the cleaning performance by the cleaning blade is enhanced.

If the toner or the additive is attached to the surface of the cleaning brush or the lubricant applying brush, and the brush is stained, the cleaning performance of the stained portion decreases. Then, a stain due to the toner may appear on the image formed on the sheet or noise may occur in the image due to unevenness in applying the lubricant or unevenness in the polishing.

In view of the above problems, JP H11-237825 describes a technique to detect a change of an electric current value flowing in the cleaning brush and to determine whether there is attached material to the cleaning brush based on the above detection. If the stain in the cleaning brush is detected, influence to the image can be suppressed by performing cleaning.

When a portion of the cleaning brush or the lubricant applying brush is stained in the axis direction, noise occurs in only a portion of the sheet in the main scanning direction. For example, an image streak occurs.

According to the method described in JP H11-237825, the degree that the entire cleaning brush is stained can be determined but the stain in a portion of the cleaning brush in the axis direction cannot be determined. Even if the degree of the stain as a whole is small, the stain in a portion of the brush causes noise in the image.

SUMMARY

An object of the present invention is to provide an image forming apparatus and a storage medium to accurately detect a stain in an axis direction of a rotating member which comes into contact with a photoconductor while rotating.

To achieve at least one of the abovementioned objects, according to an aspect of the present invention, an image forming apparatus reflecting one aspect of the present invention includes an image former which includes, an image carrier which carries a toner image transferred to a sheet; a developer which applies a developing bias and which develops the toner image on the image carrier; a conductive rotating member which rotates while coming into contact with the image carrier; and a voltage applier which applies a voltage to the rotating member, and a hardware processor which executes an attached material detection mode which detects material attached to a surface of the rotating member, wherein, in the attached material detection mode, the hardware processor controls the voltage applied by the developer and/or the voltage applier so that the developing bias is a value between a surface potential in a region on a surface of the image carrier in contact with a portion in which attached material exists on a surface of the rotating member if a reference voltage is applied by the voltage applier, and a surface potential in a region on the surface of the image carrier in contact with a portion in which the attached material does not exist on the surface of the rotating member if the reference voltage is applied, and the hardware processor controls the developer to develop a toner image on the image carrier.

According to another aspect of the present invention, a non-transitory computer-readable storage medium reflecting another aspect of the present invention has a program stored thereon for controlling a computer used in an image forming apparatus including an image former which includes, an image carrier which carries a toner image transferred to a sheet; a developer which applies a developing bias and which develops the toner image on the image carrier; a conductive rotating member which rotates while coming into contact with the image carrier; and a voltage applier which applies a voltage to the rotating member, wherein the program controls the computer to execute: an attached material detection mode which detects material attached to a surface of the rotating member, wherein, in the attached material detection mode, the voltage applied by the developer and/or the voltage applier are controlled so that the developing bias is a value between a surface potential in a region on a surface of the image carrier in contact with a portion in which attached material exists on a surface of the rotating member if a reference voltage is applied by the voltage applier, and a surface potential in a region on the surface of the image carrier in contact with a portion in which the attached material does not exist on the surface of the rotating member if the reference voltage is applied, and the developer is controlled to develop a toner image on the image carrier.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

The first embodiment is described in detail with reference to the drawings.

[Configuration of Image Forming Apparatus]

Figure 1:
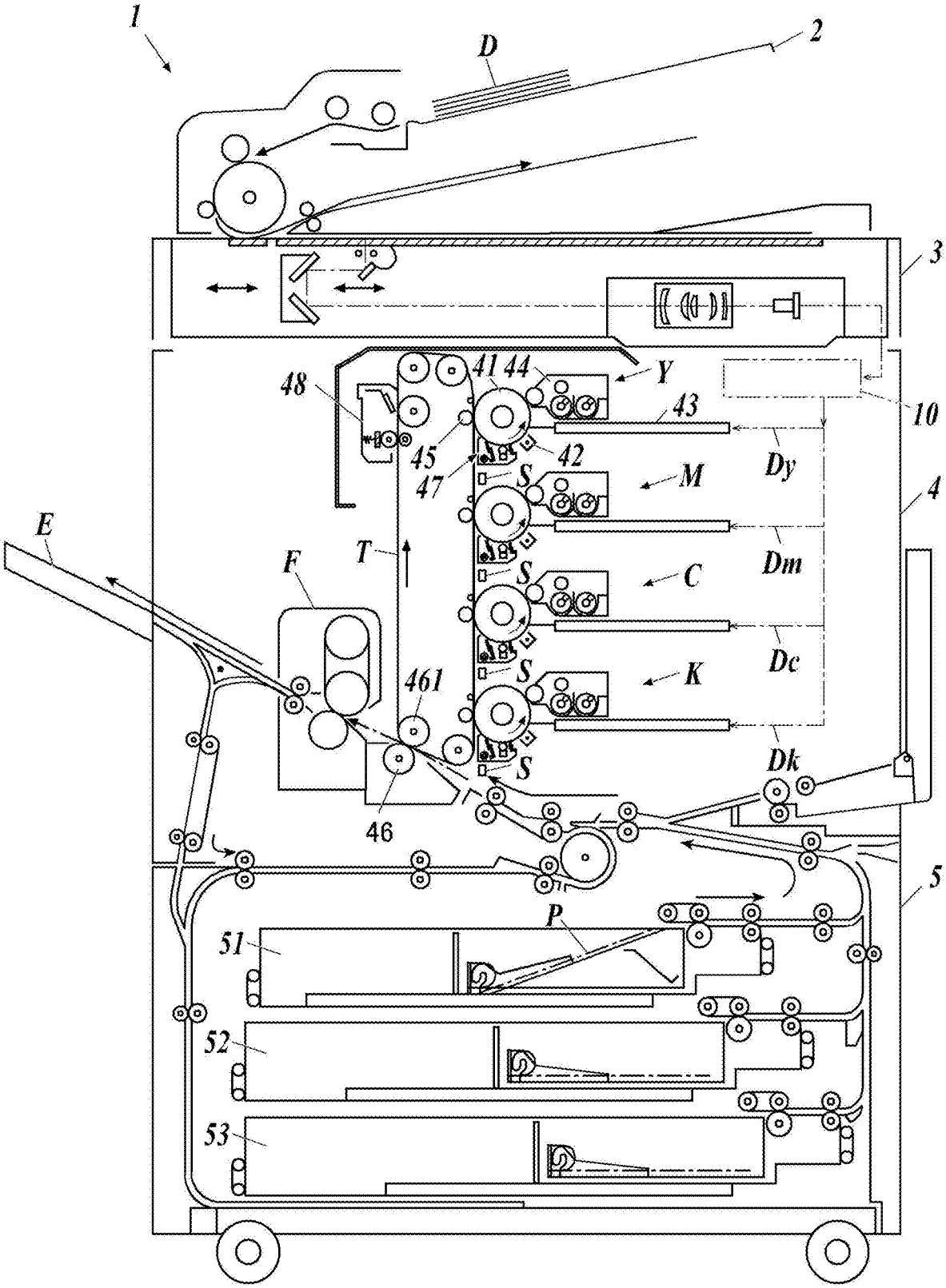
FIG. 1 is a diagram showing a schematic configuration of an image forming apparatus.
Figure 2:
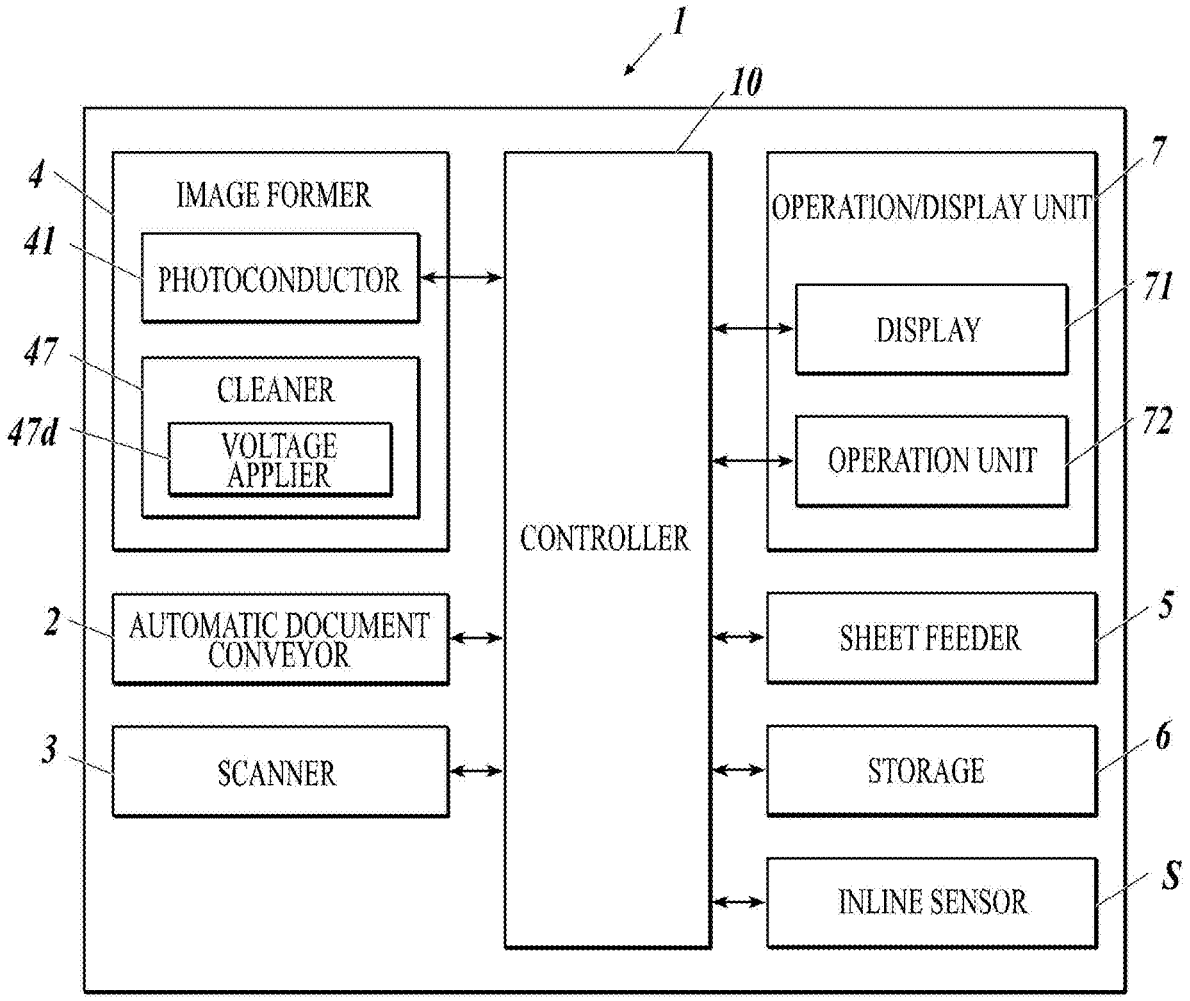
FIG. 2 is a block diagram showing a configuration of main functions in the image forming apparatus according to a first embodiment.
Figure 3:
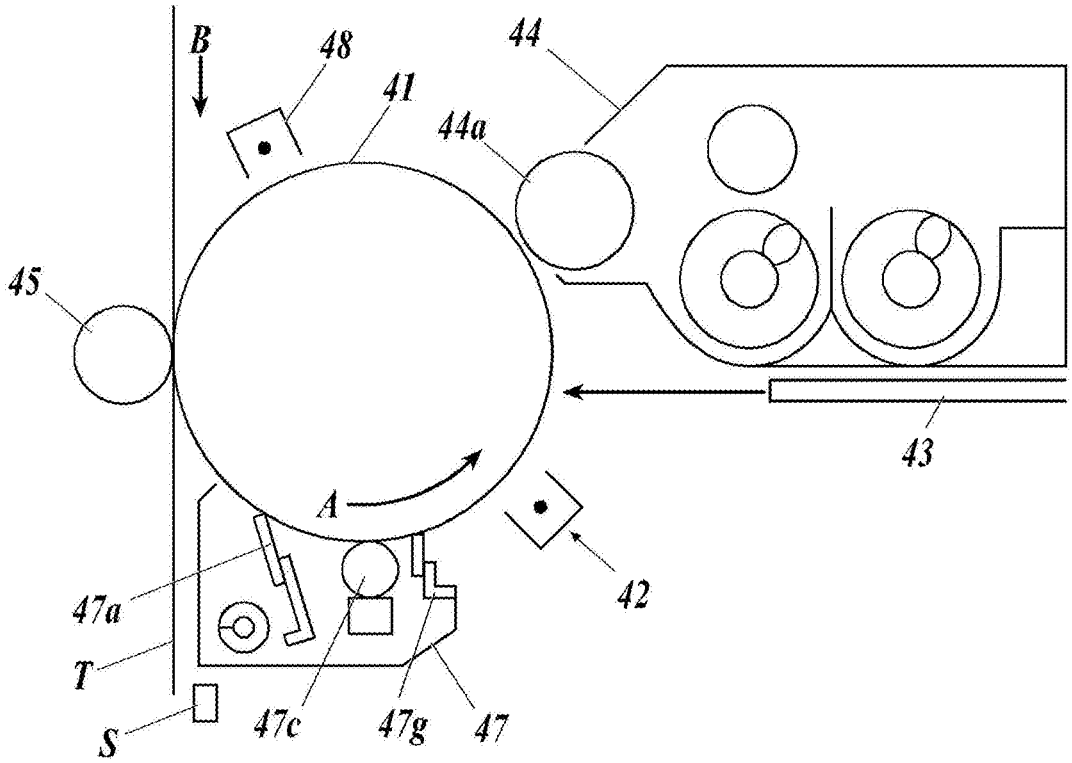
FIG. 3 is a diagram showing a schematic configuration of an image former according to the first embodiment.

The image forming apparatus 1 according to the present embodiment is a color image forming apparatus employing an intermediate transfer method which uses an electrophotographic process technique. As shown in FIG. 1 to FIG. 3, the image forming apparatus 1 includes an automatic document conveyor 2, a scanner 3, an image former 4, a sheet feeder 5, a storage 6, an operation/display unit 7, a controller 10, and an inline sensor S.

The automatic document conveyor 2 includes a placement tray to place a document D, a mechanism and conveying roller to convey the document D and the like to convey the document D to a predetermined conveying path.

The scanner 3 is provided with an optical system such as an optical source and a reflecting mirror, the optical source irradiates the document D conveyed on the predetermined conveying path or the document D placed on a platen glass and the scanner 3 receives the reflected light. The scanner 3 converts the received reflected light to an electric signal and outputs the electric signal to the controller 10.

The image former 4 includes a yellow imager Y, a magenta imager M, a cyan imager C, a black imager K, an intermediate transfer belt T, and a fixer F.

Each imager YMCK forms a toner image in yellow, magenta, cyan, or black, respectively, on a photoconductor 41, and the toner images in the colors YMCK formed on the photoconductor 41 are transferred by first transfer on the intermediate transfer belt T.

FIG. 3 is a diagram showing a schematic configuration of an image former 4. Each imager includes the following, the drum shaped photoconductor 41 (image carrier) which is driven to rotate in a direction A as shown in the diagrams, a charging device 42 which uniformly charges the surface of the photoconductor 41, an exposing device 43 which exposes the surface of the photoconductor 41 charged by the charging device 42 to form an electrostatic latent image, a developing device 44 (developer) which uses a developer including toner to visualize the electrostatic latent image formed on the exposing device 43, a first transfer roller 45 which transfers the toner image formed on the photoconductor 41 onto a sheet, a cleaner 47 which removes toner on the photoconductor 41 which passed a transfer region, and an eraser 48 which erases the latent image on the photoconductor 41. The toner image formed on the photoconductor 41 is transferred by first transfer onto an intermediate transfer belt T moving in the B direction as shown in the diagram. The toner image transferred onto the intermediate transfer belt T is transferred to the sheet by the second transfer roller 46. Then, the sheet is conveyed to the fuser F, and the toner image is fused on the sheet. An inline sensor S is positioned for the imagers YMCK on a downstream side of the rotating direction B of the intermediate transfer belt T with relation to the transfer region between the first transfer roller 45 and the photoconductor drum so that an inline sensor S is able to read the toner image on the intermediate transfer belt T.

The configuration and the operation are the same for all images YMCK. Therefore, hereinbelow, the flow of the image forming operation performed by the image former 4 is described with reference to the yellow imager Y as the example.

The photoconductor 41 includes an organic photoconductor in which a photoconductor layer is formed including resin including an organic photoconductor on an outer circumferential surface of a drum-shaped metallic base. The photoconductor 41 rotates in the direction A shown in the diagrams. The resin included in the photoconductor layer may be polycarbonate resin, silicone resin, polystyrene resin, acrylic resin, methacrylic resin, epoxy resin, polyurethane resin, vinyl chloride resin, melamine resin, for example. The photoconductor 41 includes a layer structure in which an undercoat layer (UCL), a charge generation layer (CGL), and a charge transport layer (CTL) are positioned in this order on a conductive original tube such as an aluminum tube.

The charging device 42 uses a charger to charge the photoconductor 41 to a certain electric potential in a minus polarity.

The exposing device 43 exposes a non-image region of the photoconductor 41 based on image data Dy from the controller 10 to remove charge of the exposed portion and forms the electrostatic latent image in the image region of the photoconductor 41.

The developing device 44 includes a developing sleeve 44*a* positioned facing the photoconductor 41 with the developing region in between. For example, a developing bias with an AC voltage superimposed on a DC voltage with a same polarity as the charging polarity of the charging device 42, that is, a minus polarity is applied to the developing sleeve 44*a*. With this, the developer is supplied on the electrostatic latent image formed on the photoconductor 41, and the yellow toner image is formed on the photoconductor 41. The developer includes a toner and a carrier to charge the toner. The toner is not limited and well-known toner used widely can be used. For example, it is possible to use a binder resin which includes a colorant and as necessary, a charge controlling agent or a separating agent and which is processed with an external additive. The toner particle size is not limited, and preferably, the size is about 3 to 15 μm.

The developing bias applied to the developing device 44 is controlled by the controller 10.

First transfer is performed by using the first transfer roller 45 to transfer the yellow toner image formed on the photoconductor 41 onto the intermediate transfer belt T. Similarly for the imagers MCK, first transfer is performed to transfer the toner images in magenta, cyan, and black onto the intermediate transfer belt T. With this, the toner images with the colors YMCK are formed on the intermediate transfer belt T.

The intermediate transfer belt T is a semi-conductive endless belt hung around a plurality of rollers to be supported in a rotatable state. The intermediate transfer belt T is rotated in the direction B as shown in the diagrams with the rotation of the rollers. The intermediate transfer belt T is pressed against the opposing photoconductor 41 by the first transfer roller 45. The transfer electric current according to the applied voltage flows in each first transfer roller 45. With this, first transfer is performed and each of the toner images developed on the surface of each photoconductor 41 is successively transferred to the intermediate transfer belt T by the first transfer roller 45.

The second transfer roller 46 is pressed by the intermediate transfer belt T and rotates in a manner following the intermediate transfer belt T. With this, the second transfer is performed and the toner images in the colors YMCK transferred and formed on the intermediate transfer belt T are transferred on a paper P conveyed from sheet feeding trays 51 to 53 of the sheet feeder 5. In detail, the second transfer roller 46 is positioned in contact with the second transfer opposing roller 461 with the intermediate transfer belt T in between. When the paper P passes a transfer nip formed between the second transfer roller 46 and the second transfer opposing roller 461, the second transfer is performed and the toner image on the intermediate transfer belt T is transferred onto the paper P.

The toner which is not transferred on the intermediate transfer belt T in the transfer region and which remains on the photoconductor 41 is transferred to the cleaner 47 and collected by the cleaner 47.

The photoconductor 41 in which the toner on the surface is collected by the cleaner 47 is charged again by the charging device 42 and the next electrostatic latent image is formed to form the toner image. This process is repeated.

Figure 4:
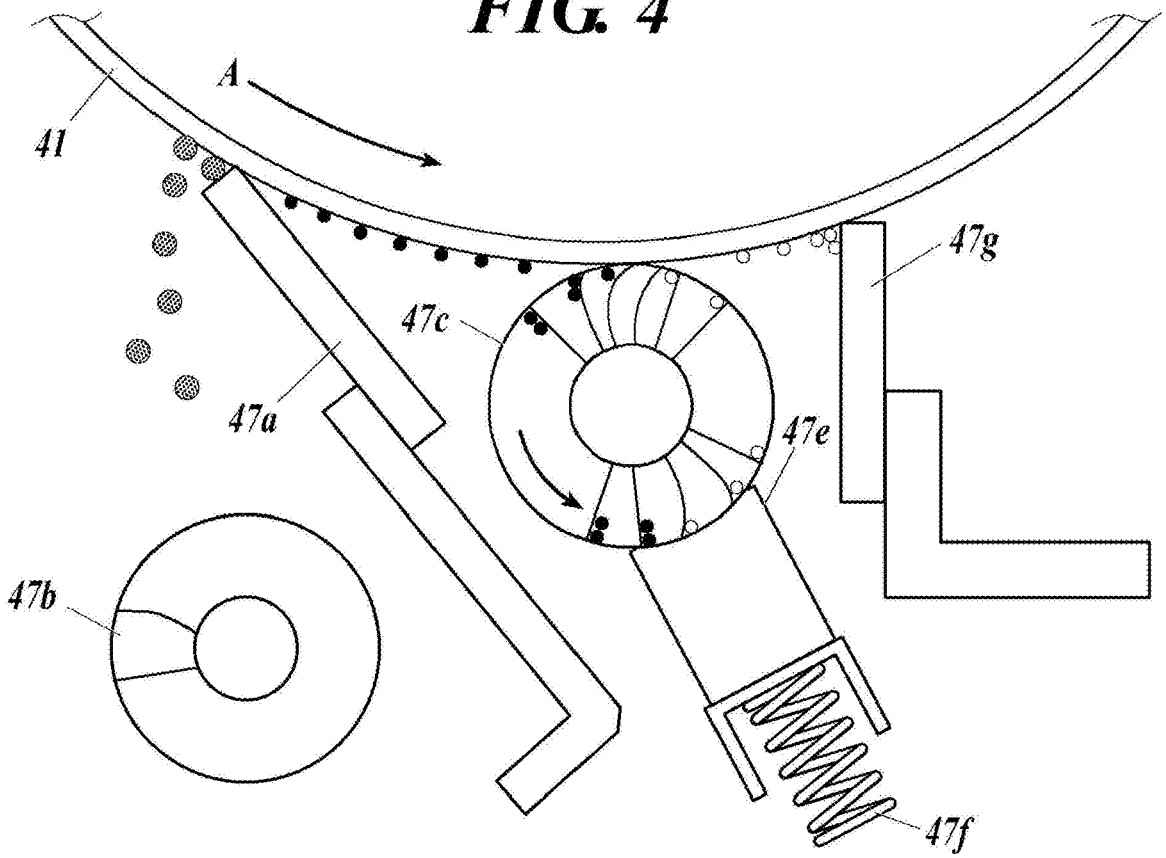
FIG. 4 is a diagram showing a schematic configuration of a cleaner.

FIG. 4 is a schematic diagram showing a configuration of a cleaner 47.

The cleaner 47 includes a cleaning blade 47*a*, a collecting screw 47*b* provided substantially below the cleaning blade 47*a*, a lubricant applying brush 47*c* provided on a downstream side in the rotating direction of the photoconductor 41 with relation to the cleaning blade 47*a*, a voltage applier 47*d* which applies voltage to the lubricant applying brush 47*c* (see FIG. 2), a solid lubricant 47*e* which supplies lubricant on the lubricant applying brush 47*c*, a presser 47*f* which presses and holds the solid lubricant 47*e* against the lubricant applying brush 47*c*, and a fixing blade 47*g* which is provided on the downstream side in the rotating direction of the photoconductor 41 with relation to the lubricant applying brush 47*c*.

For example, the cleaning blade 47*a* is an elastic body such as polyurethane rubber processed in a plate shape. The cleaning blade 47*a* is positioned so that the tip slides against the photoconductor 41. The cleaning blade 47*a* scrapes and removes the attached material such as toner which is not transferred and which remains on the surface of the photoconductor 41.

The collecting screw 47*b* rotates in one direction and the collecting screw 47*b* conveys the toner scraped and dropped by the cleaning blade 47*a* to a waste toner box (not shown).

The lubricant applying brush 47*c* is a roll brush positioned in a position so that the tip is able to come into contact with the photoconductor 41, and the lubricant applying brush 47*c* functions as the rotating member. The lubricant applying brush 47*c* includes on its surface brush hair including conductive members such as polyester and nylon. The lubricant applying brush 47*c* is provided so that the brush hair comes into contact with both the solid lubricant 47*e* and the photoconductor 41. Under the control of the controller 10, the lubricant applying brush 47*c* rotates in a counter rotation in which the surface advances in a direction opposite the advancing direction of the surface of the photoconductor 41 at the contact point with the photoconductor 41, and the lubricant applying brush 47*c* rotates to be a linear speed slower than the photoconductor 41.

The voltage applier 47*d* applies voltage to the lubricant applying brush 47*c*. The applying voltage by the voltage applier 47*d* is controlled by the controller 10.

For example, the solid lubricant 47*e* is a lubricant formed from metallic soap such as zinc stearate in a powder form from being melted, shaped and solidified. The solid lubricant 47*e* is positioned in a position in which the tip is able to come into contact with the lubricant applying brush 47*c*. The solid lubricant 47*e* is scraped off from the tip by the rotation of the lubricant applying brush 47*c*. The lubricant which is scraped off is conveyed to the photoconductor 41 and supplied to the surface of the photoconductor 41.

The presser 47*f* includes a compression spring which biases the solid lubricant 47*e* toward the direction of the lubricant applying brush 47*c*, and presses and holds the solid lubricant 47*e* toward the lubricant applying brush 47*c*.

Similar to the cleaning blade 47*a*, an elastic body such as polyurethane rubber processed in a plate shape is used as the fixing blade 47*g*. The fixing blade 47*g* is positioned so as to come into contact with the surface of the photoconductor 41 in a direction pulling the surface, and the tip of the fixing blade 47*g* slides against the photoconductor 41. The fixing blade 47*g* extends the powder of the lubricant supplied to the surface of the photoconductor 41 to form a layer on the surface of the photoconductor 41. The lubricant layer formed with zinc stearate has high separating performance and a small friction coefficient. Therefore, the quality in transfer and cleaning is good and the wearing of the photoconductor 41 can be suppressed to enable a long operating life.

The eraser 48 is an exposing unit such as the LED and is provided in the upstream side of the rotating direction of the photoconductor 41 with respect to the first transfer roller 45. The eraser 48 removes electricity in the surface of the photoconductor 41 before the transferring. With this, the potential difference of the image portion and the non-image portion on the surface of the photoconductor 41 can be made smaller.

The image former 4 uses the fuser F to heat and pressure the paper P on which the toner images in the colors YMCK are transferred by second transfer and then passes the paper P through the predetermined conveying path to eject the paper P outside the apparatus.

The flow of processes described above is the image forming process performed by the image former 4.

The inline sensor S is a sensor which can read the intermediate transfer belt T in a main scanning direction and the inline sensor S uses the image sensor such as a CCD to read the toner image formed on the intermediate transfer belt T while the paper passes. A total of four inline sensors S are provided near the imagers as described above, and the data read for each imager is transmitted sequentially to the controller 10.

The inline sensor S functions as a detector.

The sheet feeder 5 includes a plurality of sheet feeding trays 51 to 53, and a plurality of different types of paper P are stored in each sheet feeding tray 51 to 53. The sheet feeder 5 feeds the stored paper P to the image former 4 through the predetermined conveying path.

The storage 6 includes a HDD (Hard Disk Drive), a semiconductor memory, and the like, and stores data such as the program data and various setting data in a rewritable state under the control of the controller 10.

The operation/display unit 7 includes a liquid crystal display (LCD) with a touch panel and functions as a display 71 and an operation unit 72.

The display 71 displays various operation screens and an operation status of various functions according to a display control signal input from the controller 10. The display 71 receives touch operation by the user and outputs the operation signal to the controller 10.

The operation unit 72 includes various operation keys such as numeric keys and a start key, and the operation unit 72 receives various input operation by the user and outputs the operation signal to the controller 10. The user operates the operation/display unit 7 to be able to perform operation such as setting regarding the image forming including image quality setting, magnification setting, advanced setting, output setting, and paper setting, paper conveying instruction, and operation to stop the apparatus.

The controller 10 includes a CPU, a RAM, and a ROM. The CPU deploys various programs stored in the ROM to the RAM and in coordination with the various deployed programs, the controller 10 centrally controls the operation of various units in the image forming apparatus 1 such as the automatic document conveyor 2, scanner 3, image former 4, sheet feeder 5, storage 6, operation/display unit 7, and inline sensor S (see FIG. 2). For example, the electric signals are input from the scanner 3 and the controller 10 performs various image processes. The controller 10 outputs the image data Dy, Dm, Dc, Dk of the colors YMCK generated by image processing to the image former 4. The controller 10 controls the operation of the image former 4 to detect material attached to the lubricant applying brush 48*c* as described below.

[Attached Material Detection Mode]

The attached material detection mode according to the present embodiment is described with reference to the drawings. The attached material detection mode is the operation performed by the image forming apparatus 1 to detect the material attached to the surface of the lubricant applying brush 47*c*.

In the description below, "stain" means attached material such as toner on the surface of the lubricant applying brush 47*c* and the lubricant which is not applied to the photoconductor 41 and which remains on the surface of the lubricant applying brush 47*c*.

Figure 5A:
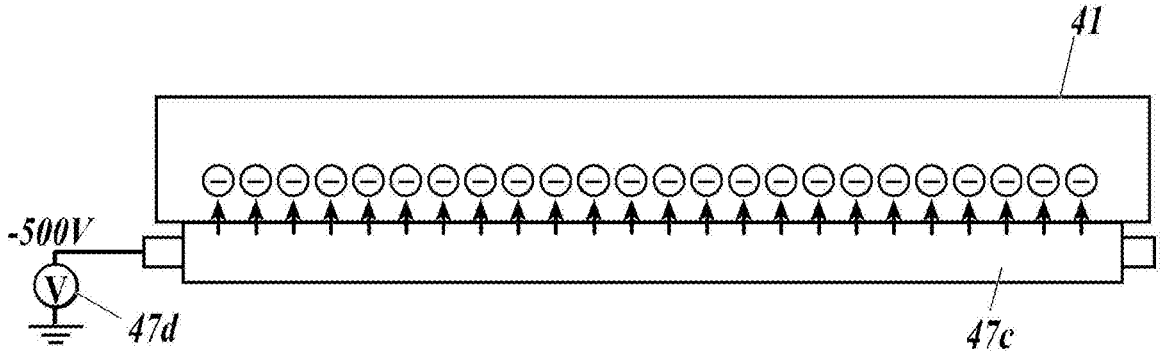
FIG. 5A to FIG. 5C are diagrams describing a mechanism of a toner development which occurs due to a stain in a lubricant applying brush.
Figure 5B:
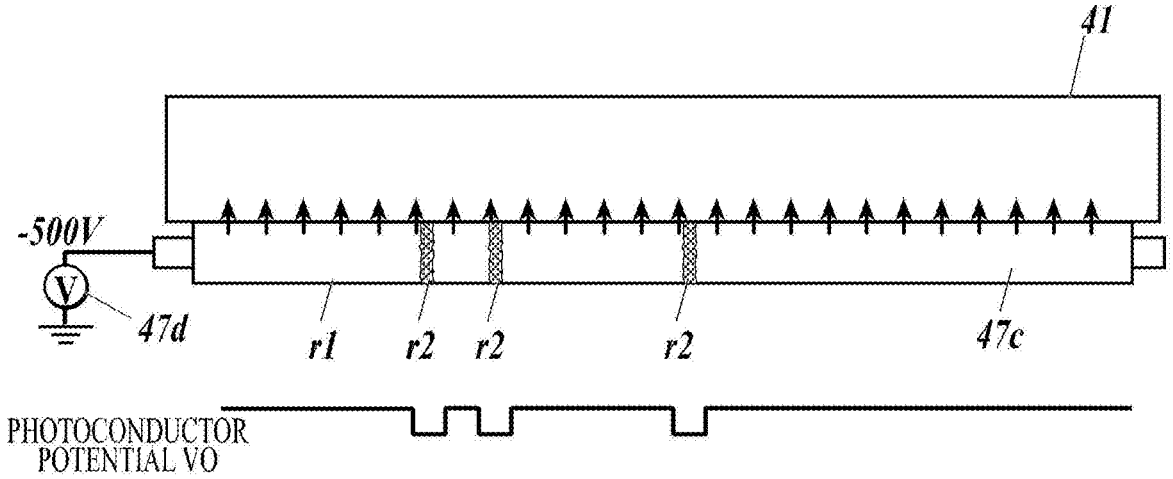
Figure 5C:
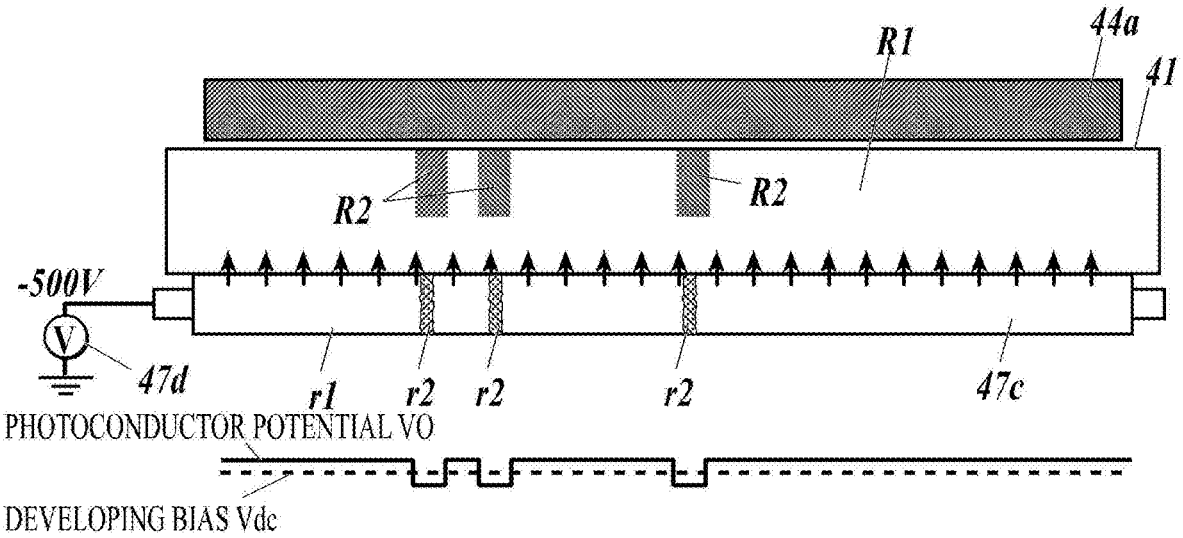

FIG. 5A to FIG. 5C are diagrams describing the mechanism of toner developed due to stain in the lubricant applying brush 47*c*.

As shown in FIG. 5A, when the image is formed, a certain voltage (reference voltage) is applied to the lubricant applying brush 47*c* by the voltage applier 47*d*. At this time, the charge of the lubricant applying brush 47*c* moves to the photoconductor 41. For example, if the voltage of −500 V is applied by the voltage applier 47*d*, minus charge moves from the lubricant applying brush 47*c* to the photoconductor 41.

Here, as shown in FIG. 5B, when there is a partial stain in a region r2 of the lubricant applying brush 47*c*, resistance of the region r2 increases. With this, the charge moved to the photoconductor 41 reduces and the surface potential of the photoconductor 41 reduces.

When the photoconductor 41 comes into contact with the developing sleeve 44*a* in a state that the charge is moved from the lubricant applying brush 47*c* to the photoconductor 41, if the surface potential of the photoconductor is V0 and the developing bias is Vdc, the toner is not developed when V0>Vdc but the toner is developed when V0<Vdc. Therefore, as shown in FIG. 5C, even if the potential is V0>Vdc in the region R1 of the surface of the photoconductor 41 in contact with the portion r1 in which there is no stain in the lubricant applying brush 47*c*, if the potential decreases and becomes V0<Vdc in the region R2 in contact with the portion r2 in which there is the stain in the lubricant applying brush 47*c*, the toner is developed.

Figure 6A:
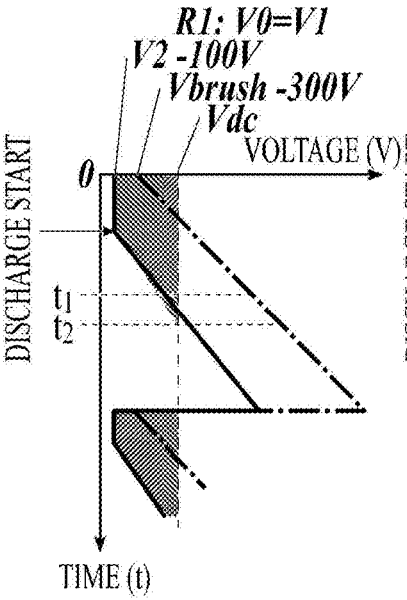
FIG. 6A to FIG. 6C are diagrams describing a relation between voltage applied to a lubricant applying brush and the toner development.
Figure 6B:
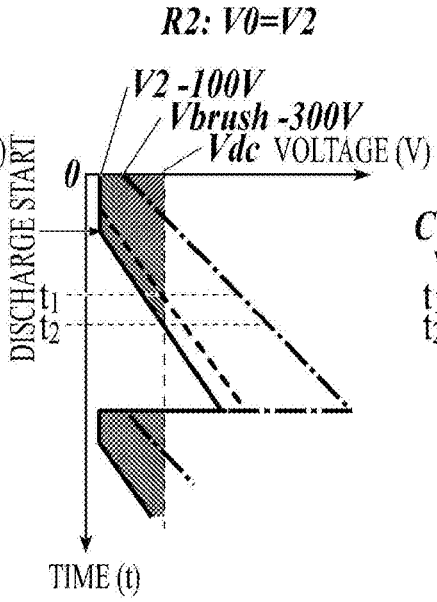
Figure 6C:
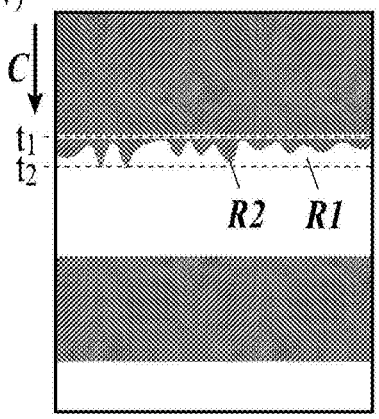

FIG. 6A to FIG. 6C are diagrams describing the relation between the voltage applied to the lubricant applying brush 47*c* and the toner developing.

According to the attached material detection mode of the present embodiment, in the state in which the operation of the eraser 48 and the charging device 42 is stopped, the voltage Vbrush applied to the lubricant applying brush 47*c* is gradually raised from the low potential. When the value is raised to a predetermined value, the value is returned to the initial value. Such triangular wave control is repeated. For example, if the initial value of the Vbrush is −300 V, the surface potential of the photoconductor 41 follows and gradually increases from −100 V.

If the region on the surface of the photoconductor 41 which comes into contact with the portion in which there is no stain in the lubricant applying brush 47*c* is R1 and the surface potential of R1 is V0=V1, as shown in FIG. 6A, the toner is developed if V1 is lower than the developing bias Vdc. However, if the surface potential of the photoconductor 41 increases, at the timing when V1 exceeds Vdc (t=t1), the toner is not developed on the photoconductor 41.

If the region on the surface of the photoconductor 41 which comes into contact with the portion in which there is the stain in the lubricant applying brush 47*c* is R2 and the surface potential of R2 is V0=V2, as shown in FIG. 6B, the increase of V2 is slower compared to the increase of V1 in R1. Therefore, the timing that V2 exceeds Vdc and that the toner is not developed (t=t2) is later compared to t1.

FIG. 6C is a diagram showing the toner image developed on the surface of the photoconductor 41. If the toner is developed in the direction C in the diagrams, the toner is developed toward the downstream side in the region R2 compared to the region R1.

The same result can be obtained by triangular wave control of the developing bias.

Figure 7A:
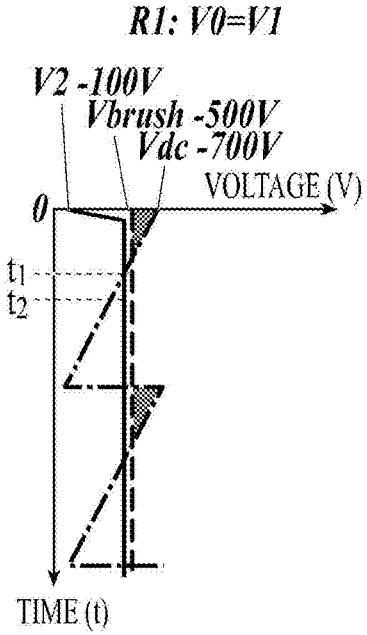
FIG. 7A to FIG. 7C are diagrams describing a relation between a developing bias and the toner development.
Figure 7B:
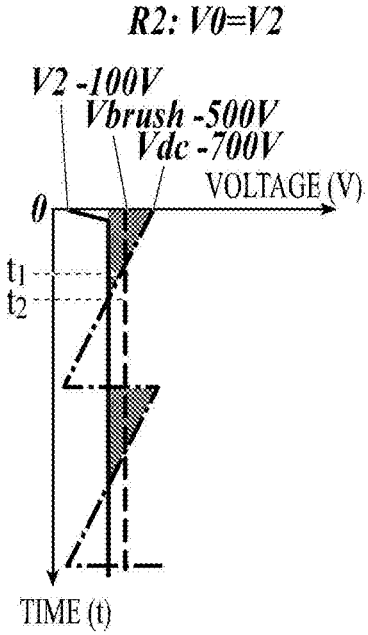
Figure 7C:
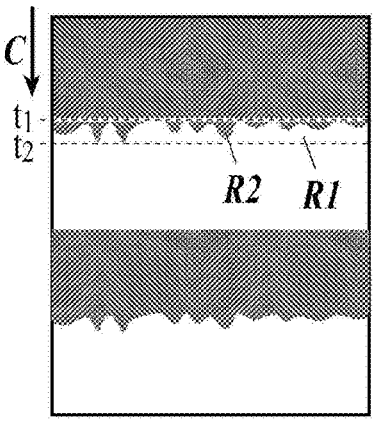

FIG. 7A to FIG. 7C are diagrams describing the developing bias control in the attached material detection mode according to the present embodiment. Similarly, in a state with the operation of the eraser 48 and the charging device 42 stopped, the developing bias Vdc is gradually lowered from the high potential. When the value is lowered to a predetermined value, the value is returned to the initial value. Such triangular wave control is repeated. For example, if the initial value of Vdc is −700 V, and Vbrush is a constant voltage of −500 V, the surface potential of the photoconductor 41 is a value which follows Vbrush.

As shown in FIG. 7A, if the surface potential of the region R1 is V0=V1, in the region R1, if the developing bias Vdc exceeds the surface potential V1 of the photoconductor 41, the toner is developed. However, if the developing bias decreases, at the timing that the Vdc is lower than the V1 (t=t1), the toner is not developed on the photoconductor 41.

As shown in FIG. 7B, if the surface potential of the region R2 is V0=V2, the surface potential V2 of the photoconductor 41 becomes a lower potential than V1 in the region R2. Therefore, the timing that the developing bias Vdc becomes lower than V2 (t=t2) is later than t1.

With this, as shown in FIG. 7C, the toner is developed toward the downstream side in the direction C shown in the diagrams in the region R2 compared to the region R1.

Therefore, in the attached material detection mode according to the present embodiment, the developing bias Vdc or the voltage Vbrush applied by the voltage applier 47*d* is controlled so that the developing bias Vdc is between the surface potential V1 of the photoconductor 41 in the region R1 when the reference voltage is applied to the lubricant applying brush 47*c* and the surface potential V2 of the photoconductor 41 in the region R2. Also, the imaging device 44 develops the toner image. By analyzing the toner image developed here, the attached state of the stain on the lubricant applying brush 47*c* can be predicted.

According to the description below, only either one of the developing bias Vdc or the voltage Vbrush applied by the voltage applier 47*d* is controlled so that the value of the developing bias Vdc is within the above range. Alternatively, both the developing bias Vdc and the applied voltage Vbrush can be controlled.

Figure 8:
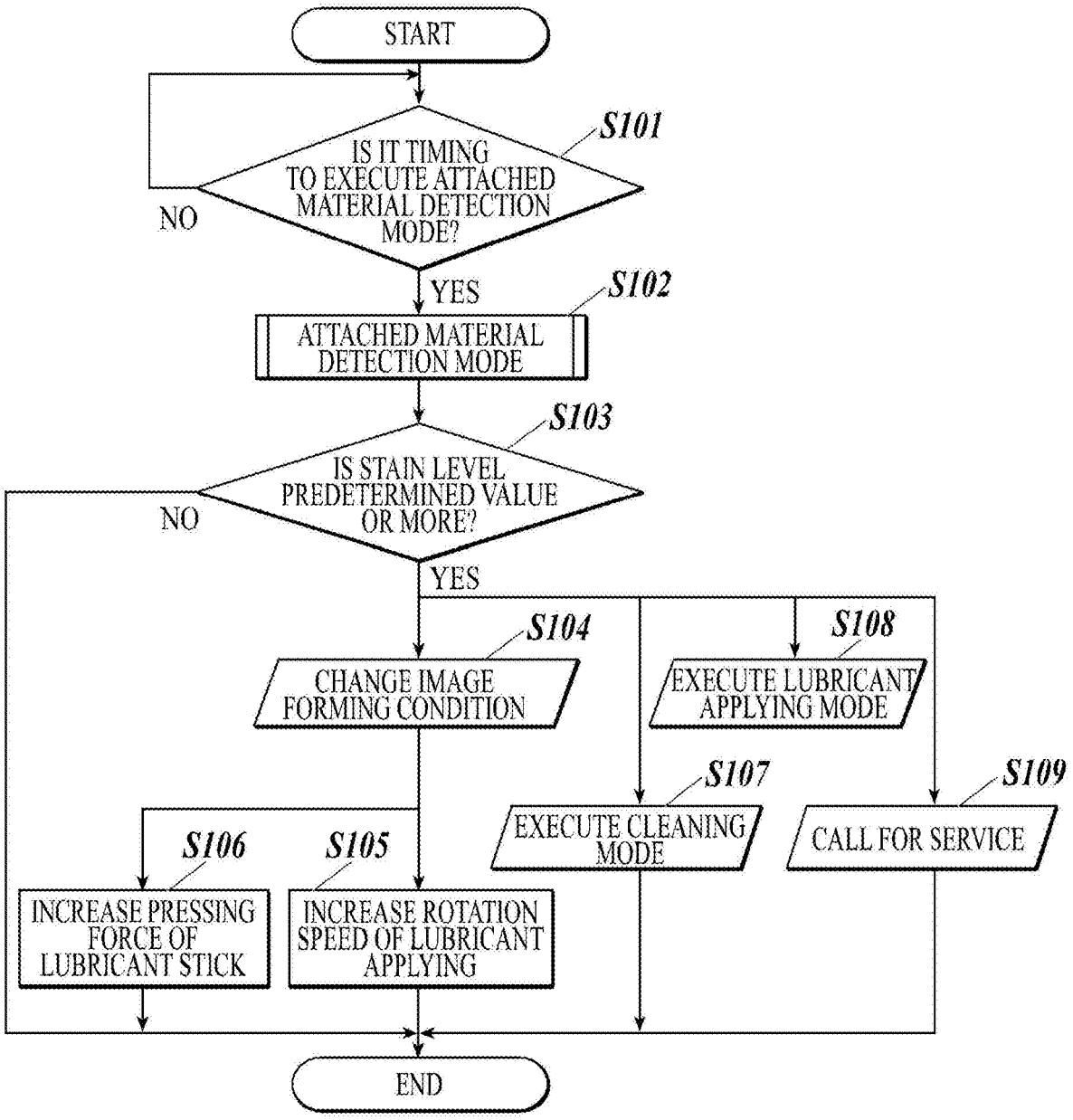
FIG. 8 is a flowchart showing an operation of the image forming apparatus according to the first embodiment.

The operation of the image forming apparatus 1 is described using the flowchart shown in FIG. 8. The process shown in FIG. 8 is executed by the controller 10 in coordination with the program stored in the storage 6.

The controller 10 determines whether it is the timing to perform the attached material detection mode (step S101). The timing that the attached material detection mode is performed is timing such as when image forming is performed in a preset distance, for example. Such timing may also be the point in time when it is assumed that there is a stain in the lubricant applying brush 47*c* or at the end of the image forming operation. The attached material detection mode can be performed periodically. Alternatively, the attached material detection mode may be performed when it is assumed that there is a stain locally in the lubricant applying brush 47*c*. Such occasion may be after continuous printing of partial coverage.

If it is determined that it is the timing to perform the attached material detection mode (step S101: YES), the controller 10 progresses to step S102. If it is determined that it is not such timing (step S101; NO), the process in step S101 is repeated.

In step S102, the attached material detection mode is performed.

Figure 9:
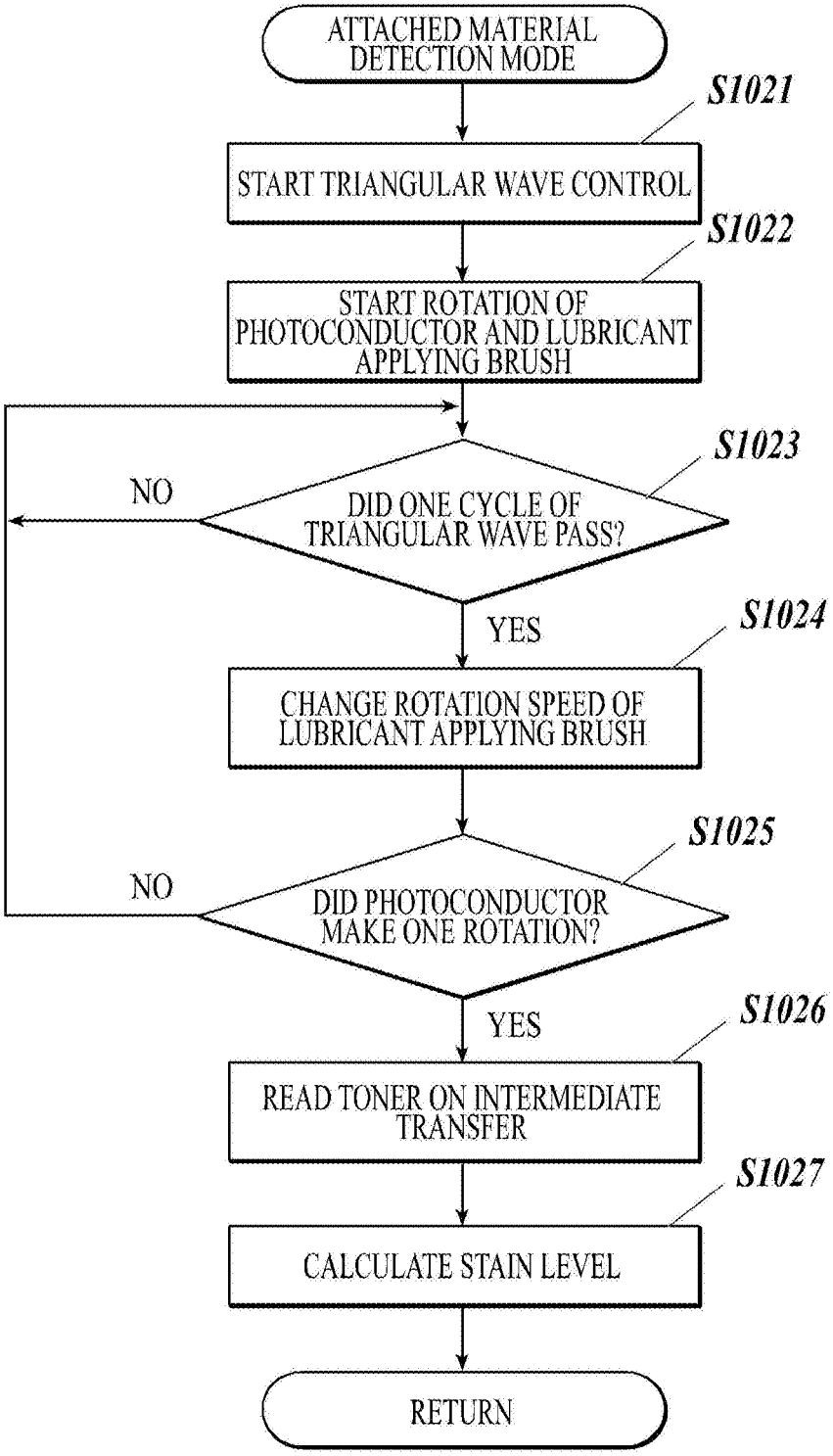
FIG. 9 is a flowchart showing an operation of the image forming apparatus according to a stain level calculating process.

FIG. 9 is a flowchart showing an operation of the image forming apparatus in the attached material detection mode. The process shown in FIG. 9 is executed by the controller 10 in coordination with the program stored in the storage 6.

First, the controller 10 starts the triangular wave control of either the voltage Vbrush applied on the lubricant applying brush 47*c* or the developing bias Vdc (step S1021).

Next, the controller 10 starts the rotation of the photoconductor 41 and the lubricant applying brush 47*c* (step S1022).

Next, the controller 10 determines whether one cycle of the triangular wave of the Vbrush or Vdc passed (step S1023). If it is determined that it is not passed (step S1023: NO), the controller 10 repeats the process of step S1023. If it is determined that it is passed (step S1023: YES), the process progresses to step S1024.

In step S1024, the controller 10 changes the rotation speed of the lubricant applying brush 47*c*.

Figure 10:
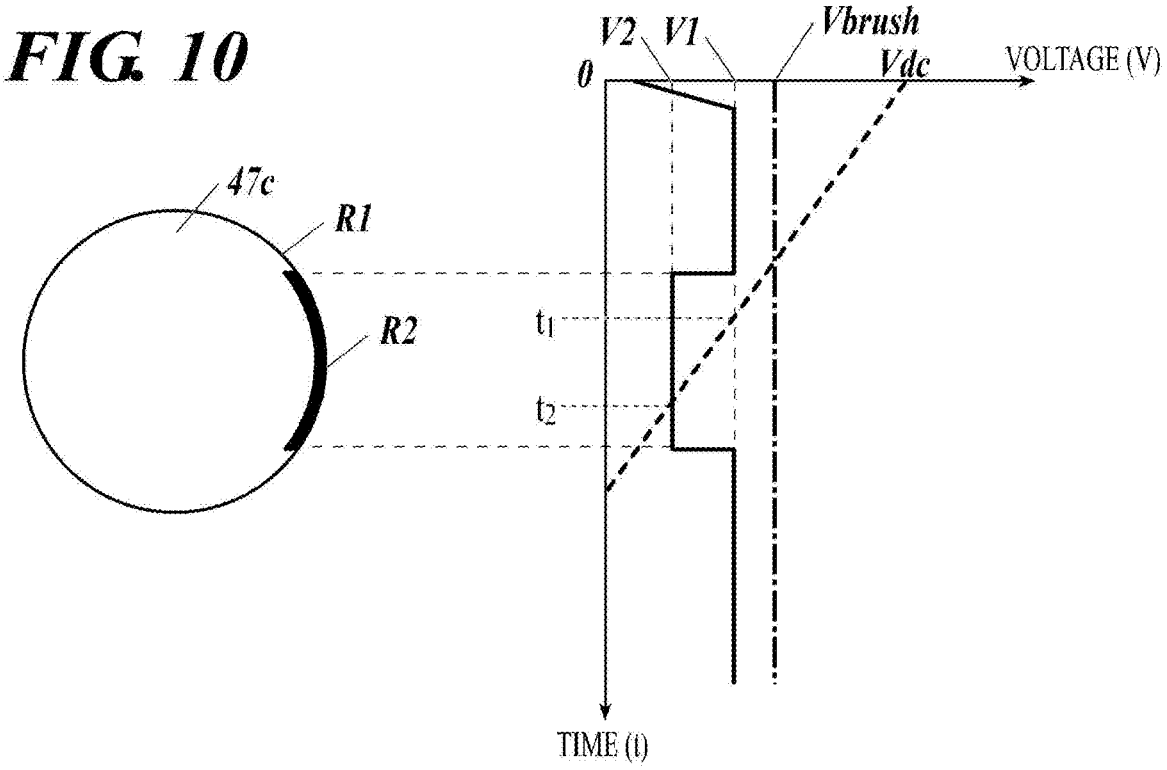
FIG. 10 is a diagram describing a relation between a stain which occurs in a circumferential direction and toner development.

The above is described with reference to FIG. 10. When there is a stain in a portion in the circumferential direction of the lubricant applying brush 47*c*, the region on the surface of the photoconductor 41 corresponding to the above is to be R2, and the other regions are to be R1. While the developing bias Vdc is controlled by triangular wave control, if the region R1 is in contact with the developing sleeve 44*a* when the Vdc decreases and reaches the surface potential V1 of the region R1, the toner is no longer developed at the timing of t1 shown in FIG. 10. If the region R2 is in contact, the toner continues to be developed until the timing t2 in which Vdc reaches the surface potential V2 of the region R2. That is, depending on whether the region R2 comes into contact with the developing sleeve 44*a* during one cycle of the triangular wave, there is a shift in the timing that the toner is no longer developed. This makes it difficult to accurately calculate the level of the stain. Therefore, for every cycle of the triangular wave, the rotation speed of the lubricant applying brush 47*c* is changed at least once. The timing that the toner is no longer developed is specified in each rotation speed. By calculating the average value of the above, it is possible to suppress the influence in the variation of the level of the stain in the circumferential direction, and the accuracy of calculating the level of the stain can be enhanced.

Next, the controller 10 determines whether the photoconductor 41 rotated once (step S1025).

Since the operation of the charging device 42 and the eraser 48 is stopped, when the photoconductor 41 starts the second cycle, there is influence of the potential remaining from the previous cycle. Therefore, the stain level of only one rotation of the photoconductor 41 is to be the target of calculation. If there is an apparatus which can erase or equalize the surface potential of the photoconductor 41 before cleaning with the eraser 48 or the pre-cleaning charger, such operation may be performed so as to be able to repeat the triangular wave control even after the second cycle of the photoconductor 41.

If it is determined that the photoconductor 41 made one rotation (step S1025: YES), the controller 10 progresses the process to step S1026. If it is determined that one rotation is not made (step S1025; NO), the process returns to step S1023.

In step S1026, the controller 10 controls the inline sensor S to read the toner on the intermediate transfer belt T in the main scanning direction. That is, the inline sensor S reads the toner image formed on the photoconductor 41 as shown in FIG. 6C or FIG. 7C transferred to the intermediate transfer belt T.

Next, the controller 10 calculates the stain level (step S1027). Here, "stain level" means the degree that the stain is attached to the surface of the lubricant applying brush 47*c*. Specifically, the stain level is calculated by the following method.

First, binarization image processing is performed on the image data read by the inline sensor S and the image data is converted to a solid/white image.

Next, if the local stain on the lubricant applying brush 47*c* is specified, in the direction of the arrow C shown in FIG. 6C or FIG. 7C, the time (or distance) from the start of the triangular wave cycle to the change from solid to white in the specific position in the axis direction (direction orthogonal to the direction C shown in FIG. 6C or FIG. 7C) of the lubricant applying brush 47*c* is measured. By performing the above throughout the entire axis direction, the measured time or distance can be an index showing the state of the stain in each position in the axis direction, that is, the local stain level.

If the degree of the stain on the entire lubricant applying brush 47*c* is specified, the average value of the time (or distance) from the start of the triangular wave cycle to the change from solid to white measured in each position in the axis direction of the lubricant applying brush 47*c* is calculated. That is, if the average time or the average distance is large, it can be said that the entire surface potential of the photoconductor 41 decreased and the entire stain level of the lubricant applying brush 47*c* is high. Therefore, the measured time or distance can be an index showing the state of the entire stain due to use of the lubricant applying brush 47*c*, that is, the entire stain level.

In step S1027, the stain level in each cycle of the triangular wave is calculated and the average is output as the stain level.

When the stain level is calculated, the attached material detection mode ends. The process returns to the flowchart shown in FIG. 8, and the controller 10 determines whether the stain level is equal to or larger than the predetermined value (step S103).

When the local stain level is calculated, if the difference between the maximum value and the minimum value of the time (or distance) measured in each position in the axis direction in step S1027 is equal to or larger than a predetermined value set in advance, it is determined that there is a local stain.

When the entire stain level is calculated, the stain level measured in step S1027 is compared with the initial value of the stain level measured in advance when the use of the lubricant applying brush 47*c* is started (average of time or distance up to the change from solid to white measured in each position in the axis direction of the lubricant applying brush 47*c* at the start of use), and if the difference from the initial value is equal to or larger than a predetermined value, it is possible to determine that there are stains throughout the entire lubricant applying brush 47*c*.

If it is determined that the stain level is not equal to or larger than the predetermined value (step S103: NO), the controller 10 ends the control. If it is determined that the stain level is equal to or larger than the predetermined value (step S103: YES), the process progresses to any of step S104, step S107, step S108 or step S109.

In step S104, the controller 10 functions as a changer, and the controller 10 changes the conditions of image forming. Specifically, the rotation speed of the lubricant applying brush 47*c* is increased (step S105). If there is the stain in the lubricant applying brush 47*c*, as a result of the lubricant scraped by the lubricant applying brush 47*c* decreasing, the applied amount decreases. Therefore, by increasing the rotation speed, the applied amount increases. Alternatively, the controller 10 raises the pressing force of the solid lubricant 47*e* (step S106). With this, the applied amount of lubricant can be increased.

As the change in the image forming conditions, both step S105 and step S106 can be performed.

In step S107, the controller 10 performs the cleaning mode of the lubricant applying brush 47*c*. Specifically, there is a method to scrape the stain by placing a blade to collect the stain in the surface of the lubricant applying brush 47*c* into contact, and rotating the lubricant applying brush 47*c* in a state separated from the photoconductor 41 and solid lubricant 47*e*.

In step S108, the controller 10 performs the lubricant applying mode. Specifically, only the photoconductor 41 and the lubricant applying brush 47*c* are rotated, and the rest of the units in the apparatus are stopped. With this, the lubricant is applied to the photoconductor 41.

In step S109, the controller 10 performs a call for service. Performing the call for service means, for example, displaying that there is a need to call for service on the display 71 to urge the user to call for service or using the image forming apparatus 1 to notify to a person in charge of maintenance through the network.

As described above, when the image forming apparatus 1 according to the present embodiment is in the attached material detection mode of the present embodiment, the developing bias Vdc and/or the voltage Vbrush applied by the voltage applier 47*d* is controlled so that the developing bias Vdc is between the surface potential V1 of the photoconductor 41 in the region R1 when the reference voltage is applied to the lubricant applying brush 47*c* and the surface potential V2 of the photoconductor 41 in the region R2. Also, the developing device 44 develops the toner image. Therefore, by analyzing the toner image developed here, the state of the stain attached to the lubricant applying brush 47*c* can be predicted. Consequently, the stain in the lubricant applying brush 47*c* in the axis direction can be accurately detected.

In the attached material detection mode, the developing bias Vdc or the voltage Vbrush applied by the voltage applier 47*d* is changed and applied while the photoconductor 41 makes one rotation. Therefore, the surface potential V1 of the photoconductor 41 in the region R1 and the surface potential V2 of the photoconductor 41 in the region R2 do not have to be obtained in advance in order to perform the above control.

The triangular wave control is performed on the developing bias Vdc or the voltage Vbrush applied by the voltage applier 47*d*. Therefore, it is possible to determine the attached state of the stain on the lubricant applying brush 47*c* using the average value of the stain level measured repeatedly, and the above is highly accurate.

Each time the cycle of the triangular wave changes, the rotation speed of the lubricant applying brush 47*c* is changed at least once. Therefore, it is possible to suppress noise caused by the variation in the stain in the lubricant applying brush 47*c* in the circumferential direction, and the level of the stain can be determined with high accuracy.

The inline sensor S detects the intensity of the toner image formed on the photoconductor 41 in the attached material detection mode. Therefore, the variation of the stain in the lubricant applying brush 47*c* in the axis direction can be accurately detected.

If the stain level is a predetermined value or more, one of the following is performed, change in the image forming condition, the cleaning mode, the lubricant applying mode, or the call for service. If there is the stain in the lubricant applying brush 47*c*, the image noise can be prevented in advance.

Second Embodiment

The second embodiment of the image forming apparatus is described with reference to the drawings. The same reference numerals are applied to the configuration similar to the first embodiment and the detailed information is omitted.

In the first embodiment, the stain level of the lubricant applying brush 47*c* including the lubricant applying function and the cleaning function for the surface of the photoconductor 41 is determined. According to the second embodiment, the stain level of the cleaning brush including the cleaning function for the surface of the photoconductor 41 is described.

Figure 11:
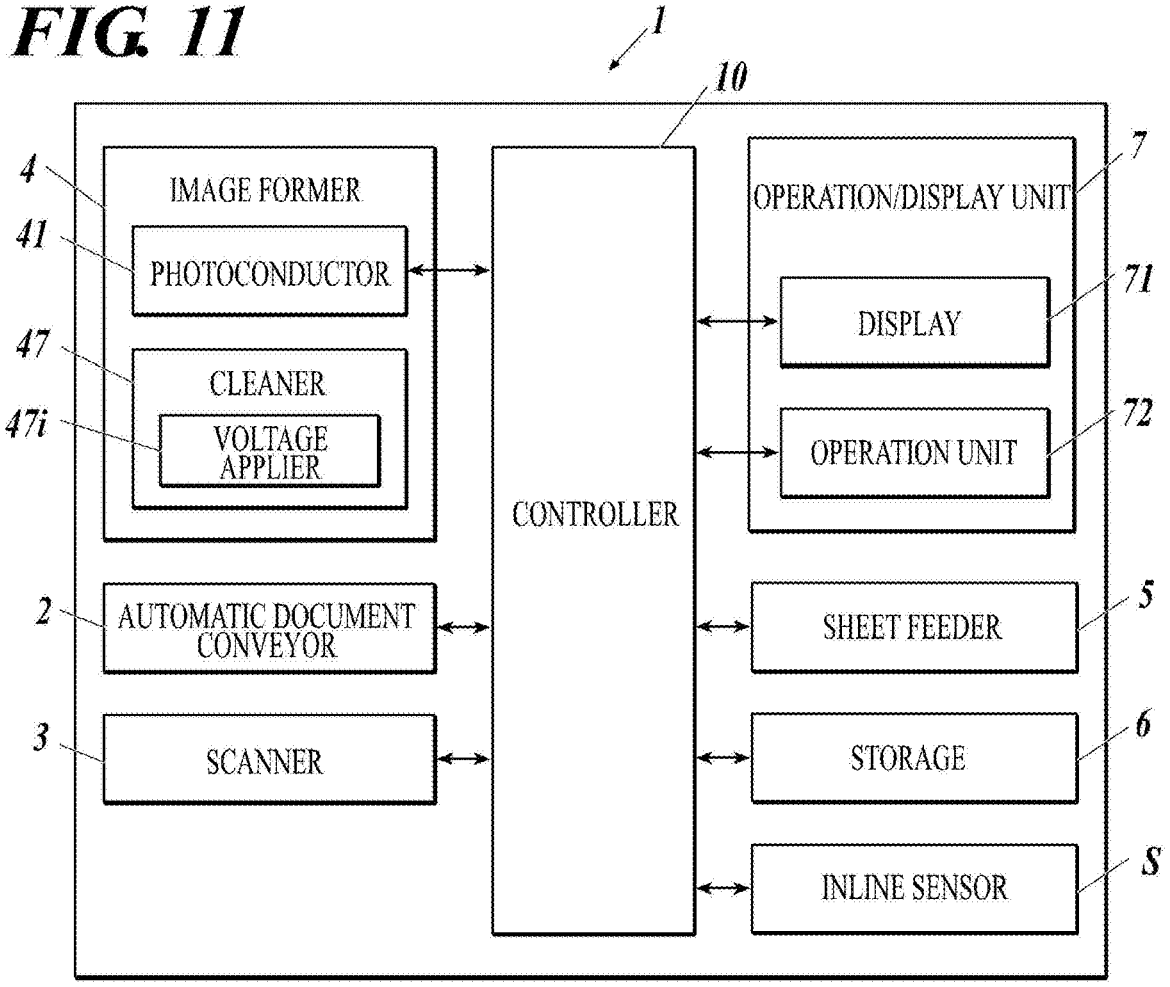
FIG. 11 is a block diagram showing a configuration of main functions in the image forming apparatus according to a second embodiment.
Figure 12:
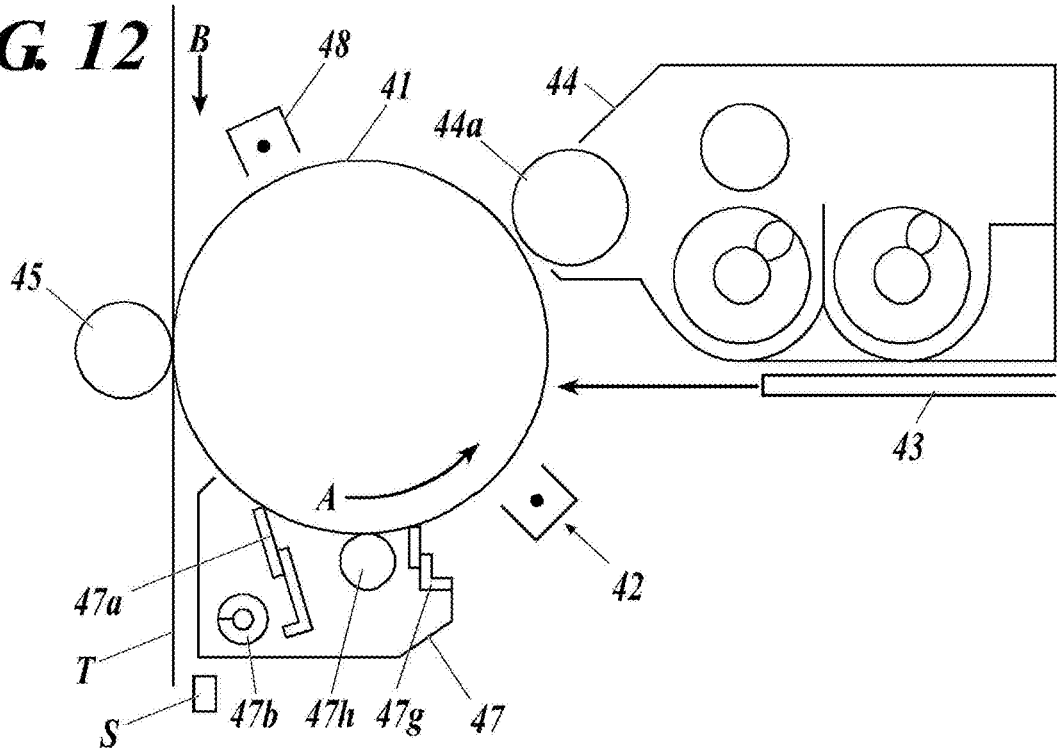
FIG. 12 is diagram showing a schematic configuration of an image former according to the second embodiment.

FIG. 11 shows a functional configuration of the image forming apparatus 1 according to the present embodiment. FIG. 12 shows a schematic configuration near the image former 4 of the image forming apparatus 1 according to the present embodiment. As shown in FIG. 11 and FIG. 12, the cleaner 47 includes a cleaning blade 47*a*, a collecting screw 47*b*, a cleaning brush 47*h*, and a voltage applier 47*i*.

The cleaning brush 47*h* is a roll brush positioned in a position in which the tip can come into contact with the photoconductor 41. The cleaning brush 47*h* includes brush hair including conductive material such as polyester or nylon on the surface and the brush hair is positioned to come into contact with the photoconductor 41. Under the control of the controller 10, the cleaning brush 47*h* rotates in a counter rotation in which the surface rotates in the direction opposite to the progressing direction of the surface of the photoconductor 41 at the contact point with the photoconductor 41. With this, the cleaning brush 47*h* removes the attached material such as the toner which is not transferred remaining on the photoconductor 41.

The voltage is applied to the cleaning brush 47*h* by the voltage applier 47*i* (see FIG. 11). The voltage applied by the voltage applier 47*i* is controlled by the controller 10.

The cleaning brush 47*h* functions as the rotating member.

According to the second embodiment, a lubricant is externally added to the toner. Alternatively, a mechanism separate from the cleaning brush is provided to apply the lubricant to the photoconductor 41.

Figure 13:
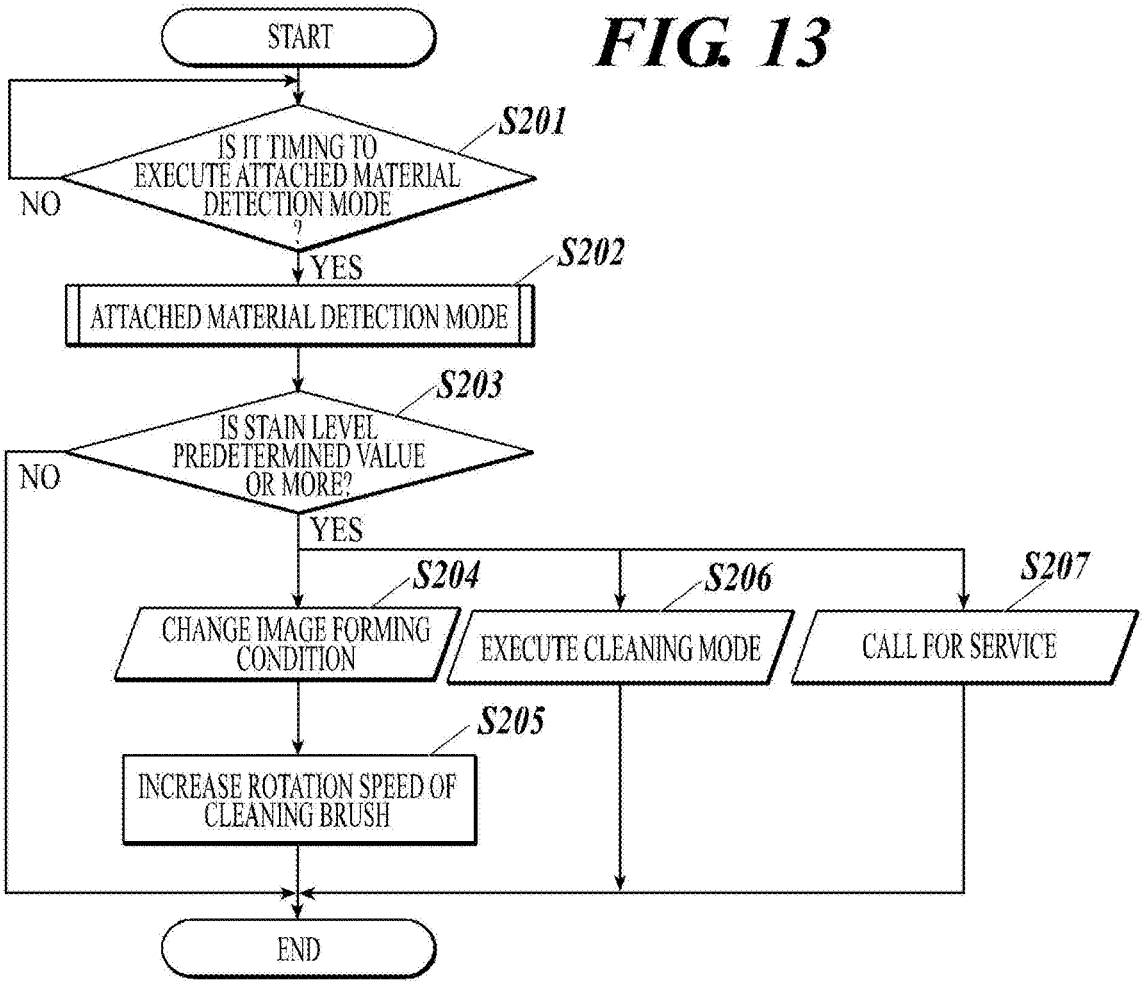
FIG. 13 is a flowchart showing an operation of the image forming apparatus according to the second embodiment.

The operation of the image forming apparatus 1 is described below with reference to the flowchart described in FIG. 13. The process shown in FIG. 13 is executed by the controller 10 in coordination with the program stored in the storage 6.

First, the controller 10 determines whether it is the timing to perform the attached material detection mode (step S201). If it is determined that it is the timing to perform the attached material detection mode (step S201: YES), the controller 10 progresses the process to step S202. If it is determined that it is not such timing (step S201: NO), the process in step S201 is repeated.

The attached material detection mode in step S202 is similar to step S102, and therefore the description is omitted.

In step S203, the controller 10 determines whether the stain level is equal to or larger than a predetermined value, and when the controller 10 determines that the value is equal to or larger than a predetermined value (step S203: YES), the process progresses to step S204, S206 or step S207. However, if it is determined that it is not the predetermined value or more (step S203: NO), the control ends.

In step S204, the controller 10 functions as a changer to change the image forming condition. Specifically, the controller 10 increases the rotation speed of the cleaning brush 47*h* (step S205). With this, the cleaning properties by the cleaning brush 47*h* to clean the surface of the photoconductor 41 can be enhanced.

In step S206, the controller 10 performs the cleaning mode of the cleaning brush 47*h*. Specifically, there is a method to scrape the stain by placing the blade to collect the stain in the surface of the cleaning brush 47*h* into contact, and rotating the cleaning brush 47*h* in a state separated from the photoconductor 41.

In step S207, the controller 10 performs a call for service.

As described above, the image forming apparatus 1 according to the present embodiment is able to accurately detect the stain in the cleaning brush 47*h* in the axis direction.

If the stain level is equal to or larger than a predetermined value or more, any of the following is performed, the change in the image forming condition, the cleaning mode, or the call for service. With this, it is possible to prevent in advance noise in the image when there is the stain in the cleaning brush 47*h*.

Other Embodiments

The embodiments are described specifically above, but the embodiments described above are merely preferable examples, and the embodiments are not limited to the above.

In the embodiments above, the voltage applied to the lubricant applying brush 47*c* or the cleaning brush 47*h* or the developing bias controlled by triangular wave control is described but the embodiments are not limited to the above.

For example, the surface potential V1 of the photoconductor 41 in the region R1 and the surface potential V2 of the photoconductor 41 in the region R2 are measured in advance, and the voltage applied to the lubricant applying brush 47*c* or the cleaning brush 47*h* or the developing bias can be controlled to a certain value so that the developing bias is a value between V1 and V2.

According to the present embodiment, the inline sensor S as the detector reads the toner image on the intermediate transfer belt T in the main scanning direction, but the embodiments are not limited to the above. The toner image can be detected on the photoconductor 41 in the axis direction, and the toner image on the photoconductor 41 can be directly read. A post processing device connected downstream of the image forming apparatus 1 can read the image formed on the sheet.

Alternatively, the apparatus may not be provided with an inline sensor S, and the image formed on the output sheet may be confirmed by sight by the user.

According to the above description, as the computer readable medium including the program to implement the embodiment, examples using a nonvolatile memory or a hard disk are disclosed but the embodiments are not limited to the above. For example, a portable recording medium such as a CD-ROM can be applied as the computer readable medium. A carrier wave is also applied as the medium to provide data of the program according to the embodiments through the communication lines.

The detailed configuration and the detailed operation of the devices included in the image forming apparatus can be suitably changed without leaving the scope of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-208518, filed on Nov. 6, 2018, including description, claims, drawings and abstract is incorporated herein by reference in its entirety.

What is claimed is:

1. An image forming apparatus comprising:

an image former which includes, an image carrier which carries a toner image transferred to a sheet;

a developer which applies a developing bias and which develops the toner image on the image carrier;

a conductive rotating member which rotates while coming into contact with the image carrier; and a voltage applier which applies a voltage to the rotating member, and a hardware processor which executes an attached material detection mode which detects material attached to a surface of the rotating member, wherein, in the attached material detection mode, the hardware processor controls the voltage applied by the developer and/or the voltage applier so that the developing bias is a value between a surface potential in a region on a surface of the image carrier in contact with a portion in which attached material exists on a surface of the rotating member if a reference voltage is applied by the voltage applier, and a surface potential in a region on the surface of the image carrier in contact with a portion in which the attached material does not exist on the surface of the rotating member if the reference voltage is applied, and the hardware processor controls the developer to develop a toner image on the image carrier.

2. The image forming apparatus according to claim 1, wherein in the attached material detection mode, the hardware processor rotates the image carrier and controls the voltage applier to apply voltage which changes at least within one rotation of the image carrier.

3. The image forming apparatus according to claim 1, wherein in the attached material detection mode, the hardware processor rotates the image carrier and controls the developer to apply voltage which changes at least within one rotation of the image carrier.

4. The image forming apparatus according to claim 2, wherein a waveform of the applied voltage is a triangular wave.

5. The image forming apparatus according to claim 4, wherein the hardware processor changes a rotation speed of the rotating member at least once each time a cycle of a triangular wave of the applied voltage changes.

6. The image forming apparatus according to claim 1, further comprising a detector which detects an intensity of the toner image formed on the image carrier in an axis direction in the attached material detection mode.

7. The image forming apparatus according to claim 1, wherein the hardware processor changes an image forming condition for the image formed by the image former if an amount of attached material attached to the surface of the rotating member is equal to or more than a predetermined amount.

8. The image forming apparatus according to claim 7, wherein the hardware processor increases a rotation speed of the rotating member when the amount of attached material attached to the surface of the rotating member is equal to or more than the predetermined amount.

9. The image forming apparatus according to claim 1, wherein the rotating member is a cleaning brush which removes toner on the surface of the image carrier.

10. The image forming apparatus according to claim 1, wherein the rotating member is a lubricant applying brush which applies lubricant to the surface of the image carrier.

11. The image forming apparatus according to claim 10, further comprising a solid lubricant in contact with the rotating member, wherein, the hardware processor changes an image forming condition for the image formed by the image former if an amount of attached material attached to the surface of the rotating member is equal to or more than a predetermined amount, and the hardware processor increases pressing force of the solid lubricant on the rotating member if the amount of attached material attached to the surface of the rotating member is equal to or more than the predetermined amount.

12. The image forming apparatus according to claim 10, wherein, the hardware processor changes an image forming condition for the image formed by the image former if an amount of attached material attached to the surface of the rotating member is equal to or more than a predetermined amount, and the hardware processor executes a lubricant applying mode in which the rotating member applies lubricant to the surface of the image carrier if the amount of attached material attached to the surface of the rotating member is equal to or more than the predetermined amount.

13. The image forming apparatus according to claim 1, wherein the hardware processor executes a cleaning mode which removes the attached material attached to the surface of the rotating member if an amount of attached material attached to the surface of the rotating member is equal to or more than a predetermined amount.

14. The image forming apparatus according to claim 1, wherein the hardware processor executes a call for service if an amount of attached material attached to the surface of the rotating member is equal to or more than a predetermined amount.

15. A non-transitory computer-readable storage medium having a program stored thereon for controlling a computer used in an image forming apparatus including an image former which includes, an image carrier which carries a toner image transferred to a sheet; a developer which applies a developing bias and which develops the toner image on the image carrier; a conductive rotating member which rotates while coming into contact with the image carrier; and a voltage applier which applies a voltage to the rotating member, wherein the program controls the computer to execute:

an attached material detection mode which detects material attached to a surface of the rotating member, wherein, in the attached material detection mode, the voltage applied by the developer and/or the voltage applier are controlled so that the developing bias is a value between a surface potential in a region on a surface of the image carrier in contact with a portion in which attached material exists on a surface of the rotating member if a reference voltage is applied by the voltage applier, and a surface potential in a region on the surface of the image carrier in contact with a portion in which the attached material does not exist on the surface of the rotating member if the reference voltage is applied, and the developer is controlled to develop a toner image on the image carrier.

* * * * *